United States Patent [19]

Tsubaki et al.

[11] 4,385,296

[45] May 24, 1983

[54] REMOTE-CONTROLLED AUTOMATIC CONTROL APPARATUS

[75] Inventors: Toshio Tsubaki; Masayoshi Sunada; Shigeru Matsuoka; Kenji Nakamura, all of Hitachi, Japan

[73] Assignee: Hitachi, Ltd., Tokyo, Japan

[21] Appl. No.: 332,759

[22] Filed: Dec. 21, 1981

Related U.S. Application Data

[63] Continuation of Ser. No. 47,884, Jun. 12, 1979, abandoned.

[30] Foreign Application Priority Data

Jun. 14, 1978 [JP] Japan ..... 53-72501
Jun. 14, 1978 [JP] Japan ..... 53-72505
Sep. 29, 1978 [JP] Japan ..... 53-119316

[51] Int. Cl.[3] ..... G08C 19/00

[52] U.S. Cl. ..... 340/825.72; 340/825.69; 49/25; 318/16

[58] Field of Search ..... 340/825.72, 825.63, 340/825.73–825.76, 825.69, 825.31, 825.44–825.48, 696, 539, 825.58, 825.56; 49/25; 455/603, 352, 353, 137, 179, 184, 185, 186; 318/16, 581

[56] References Cited

U.S. PATENT DOCUMENTS 3,513,443 5/1970 Andersen ..... 340/825.44
3,625,328 12/1971 Carll ..... 49/28
3,906,348 9/1975 Willmott ..... 340/825.63
4,064,487 12/1977 Russell et al. ..... 340/825.58
4,141,010 2/1979 Umpleby et al. ..... 340/825.63

FOREIGN PATENT DOCUMENTS 1423126 1/1976 United Kingdom ..... 340/825.72

*Primary Examiner*—John W. Caldwell, Sr.
*Assistant Examiner*—Donnie L. Crosland
*Attorney, Agent, or Firm*—Antonelli, Terry & Wands

[57] ABSTRACT

A remote-controlled automatic door control apparatus includes a door, a driving unit connected to the door for driving the door to open and closed positions, and a control arrangement for controlling the door operation through the driving unit and including a radio communication system having a transmitter and a receiver. A signal containing a specific code transmitted from the transmitter is received by the receiver and collated with a code set previously in the receiver, and if they have a predetermined relationship with each other, an operation command is issued to the driving unit. The transmitter is capable of being set to a specific code, and the receiver includes a memory device for storing the specific code transmitted from the transmitter. A signal switching device is further provided for actuating the collating operation for collating the stored code with the signal from the transmitter under normal conditions and for storing a signal from the transmitter in the memory device if required.

21 Claims, 10 Drawing Figures

FIG. 3
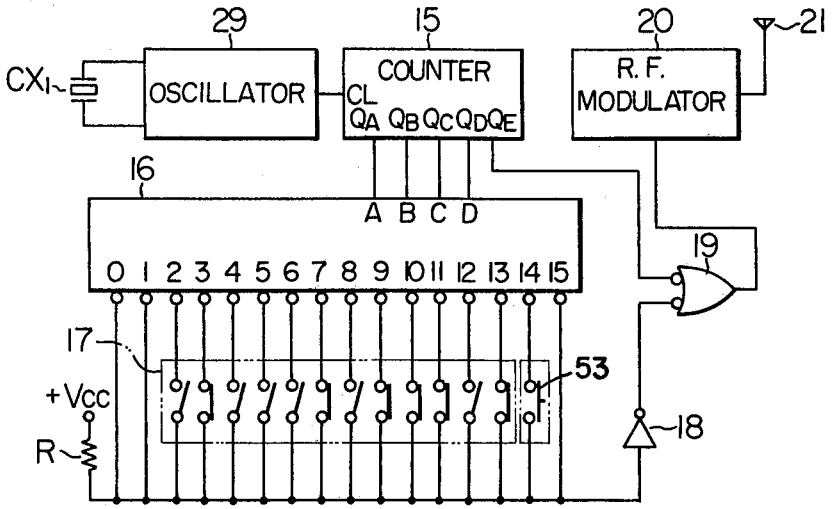
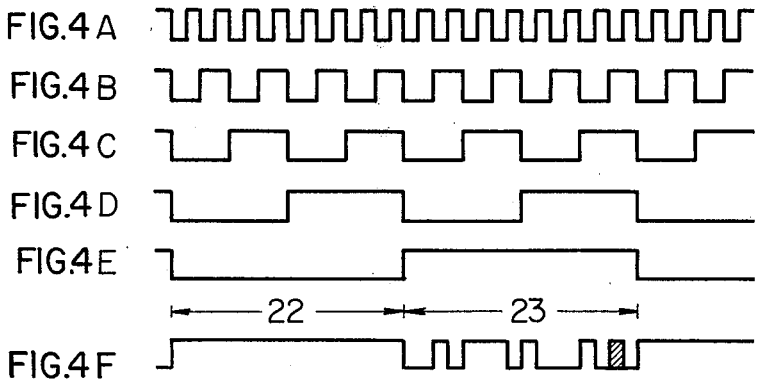

(a)
(b)
(c)
(d)

REMOTE-CONTROLLED AUTOMATIC CONTROL APPARATUS

This is a continuation of application Ser. No. 047,884 filed June 12, 1979 now abandoned.

The present invention relates to a control apparatus for handling a garage door operating device or other object by remote control, or more in particular to an apparatus comprising transmitter and receiver means for respectively sending and receiving only a specific signal for controlling an object in accordance with a received signal.

In conventional automatic garage door operating devices of this kind subjected to remote control, a specific code (hereinafter referred to as the key code) is set in advance in the transmitter and the receiver respectively, the key code set in the transmitter is sent, the key code set in the receiver is collated with the code contained in the received signal, and it is determined whether these codes have a predetermined relationship with each other.

Except where the same key code is used for all transmitters and receivers or each code is set at the time of production of the equipment, operation of the equipment is complicated if the operator sets his own key code at the time of installation or changes the key code during the operation of equipment.

In other words, if the key code is fixed, the opening and closing operation of the door poses no problem, while it is likely that the garage door may be undesirably opened in response to a signal transmitted from a third person. In this case, the key code fails to perform its original function. A key code is useless for prevention of theft or other crimes unless it is specific only to the operator.

For this reason, it is common practice for the operator to set his own key code when installing the garage door control device. In this case, the key code must be set while securing a match between the key codes of the transmitter and receiver.

This job is not so troublesome for a simple key code having, say, four digits or thereabouts. When the number of digits reaches more than ten, say, sixteen, however, it is very complex and troublesome to set such a key code accurately in the transmitter and receiver.

Further, the automatic door control device using remote control radio communication means has a manual switch for cutting off power or a received signal from the communication means, which is mounted on the control device proper for prohibiting the door operation. It is impossible to turn-off such a switch after a person passing through the door having an automatic door control function causes the door to operate automatically. If the door is to be locked, the person must first lock the automatic door inside thereof and then go out by way of a manual door other than the automatic door, thus locking the manual door manually. Another shortcoming is that in the case of a garage door with the automatic door operating device mounted on the garage ceiling, the person is required to operate the lock switch by tripod or other ladder means.

The present invention has been developed to overcome the above-mentioned disadvantages, and an object thereof is to provide an automatic control apparatus in which the signal transmitted from the transmitter is stored in advance as a key code in the receiver, so that normally this stored key code is collated with the received signal to issue a command to the door operating device and a signal switching means is used only when a key code is stored in the storage means, thus facilitating the setting of a key code at the receiving end.

Another object of the present invention is to provide an automatic control apparatus in which, in the case where a door operation control signal and a door lock command signal are received from the radio communication means at the same time, they are temporarily stored and after the door operation ends, the stored signals are produced, thus cutting off the main signal in the control apparatus by the received signals and making the control apparatus inoperable.

According the present invention, there is provided a control apparatus in which a signal containing a key code is transmitted from a transmitter, the signal thus received by a receiver is collated with a key code set in the receiver in advance, and a load is controlled when the two signals have a predetermined relationship with each other, the apparatus comprising means for setting a key code at least at the transmitting end, means for storing the key code transmitted to the receiving end and means for collating the signal stored in the storage means with the received signal, the collating means being switched as required to store the signal transmitted from the transmitter in the storage means.

The foregoing and other objects as well as the characteristic features of the invention will become more apparent from the following description taken in conjunction with the accompanying drawings, in which:

FIG. 3 is a circuit diagram of the transmitter section of the control apparatus according to the present invention;

FIG. 4 is a time chart showing output waveforms at various parts of the apparatus shown in FIG. 3;

The apparatus according to the present invention will be described below with reference to an embodiment.

Figure 1:
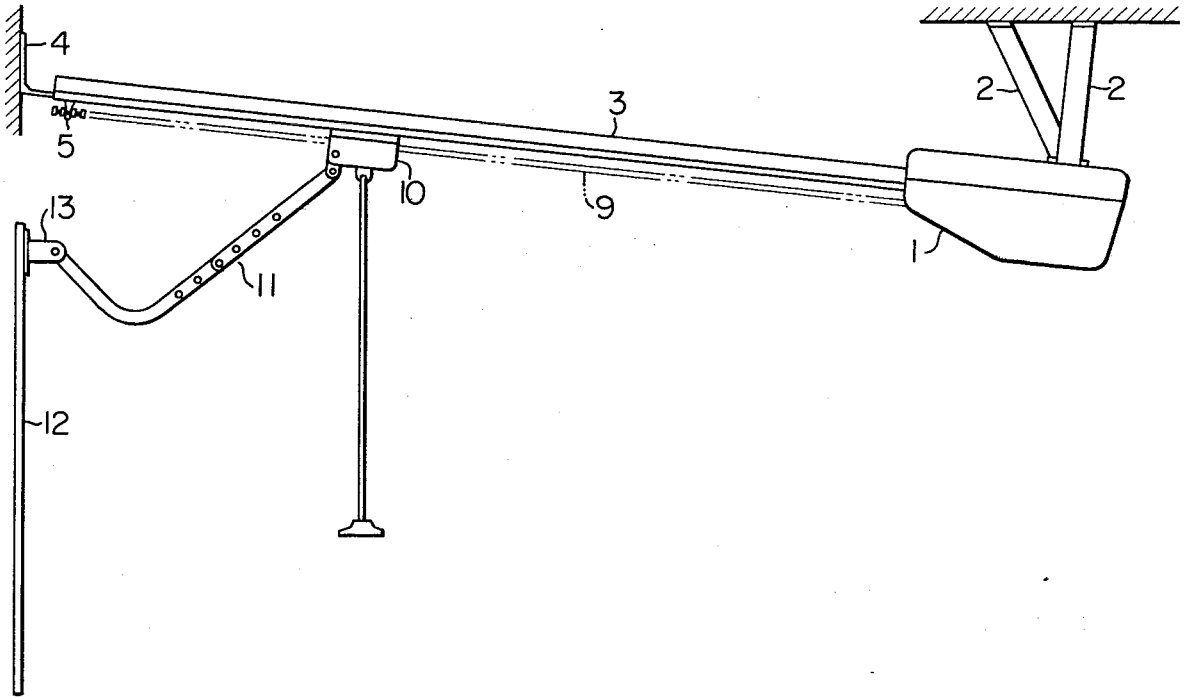
FIG. 1 is a diagram for explaining the general configuration of a garage door operating device to which the apparatus according to the present invention is applied.

The schematic diagram of FIG. 1 shows the general configuration of the garage door operating device using the apparatus according to the present invention.

In the drawing, reference numeral 1 shows a main body containing a drive unit and a control unit. The main body 1 is secured to the ceiling or the like in the garage through fixing rods 2. Numeral 3 shows a rail an end of which is held to the body 1, the other end thereof being secured to the ceiling or wall through a fixing metal 4. An end of the rail 3 is fitted with a sprocket 5 rotatably.

Figure 2:
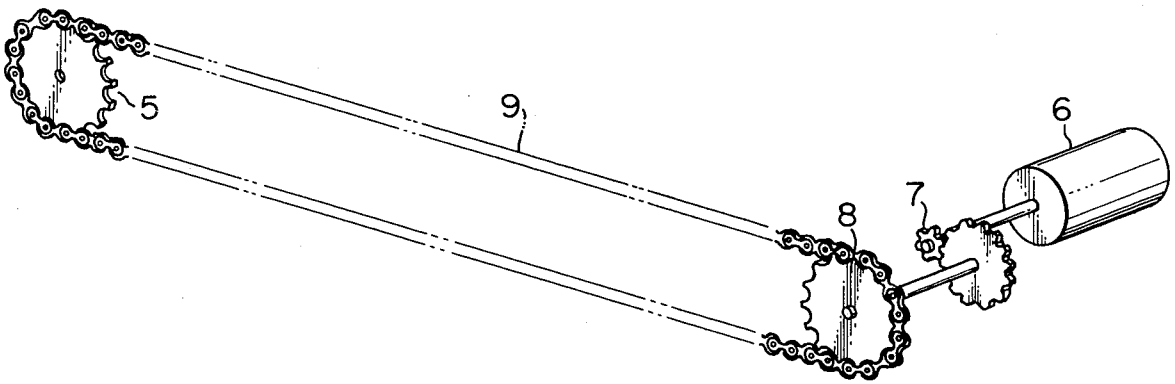
FIG. 2 is a diagram for explaining the construction of the drive section of the device in FIG. 1.

On the other hand, the motor 6 for the drive unit arranged in the body 1 is coupled with the driving sprocket 8 through a decelerator section 7 as shown in FIG. 2. A roller chain 9 is suspended in loop between the driving sprocket 8 and the sprocket 5 mounted at an end of the rail 3.

Numeral 10 shows a trolley, which is coupled to the roller chain 9 and is driven by the roller chain 9 guided by the rail 3. An end of the connecting rod 11 is fixed on the trolley 10, and the other end of the connecting rod 11 is mounted on the fixing metal 13 secured to the door 12.

In the door operating device having the abovementioned construction, upon application of an operating command to the motor 6 in the main body 1 through a control device not shown, the motor 6 begins to run and is decelerated by the decelerator section 7, thus driving the roller chain 9 through the driving sprocket 8.

Since this roller chain 9 is coupled with the trolley 10, the trolley 10 turns in the same direction as the roller chain 9, thus controlling the opening and closing operation of the door 12.

A device such as this is disclosed in detail by U.S. Pat. No. 3,625,328.

Now, explanation will be made of the transmitter circuit of the control apparatus according to this invention with reference to FIG. 3. An oscillator element Cx1 including a crystal, ceramics or the like oscillates at an audible frequency in cooperation with an oscillator 29, which signal is applied as a clock signal for the counter 15. The counter 15 includes a 5-bit binary counter with four-bit output terminals $Q_A$ to $Q_D$ connected to the input terminals A to D of the decoder 16 respectively. The 16 output terminals of the decoder 16 are connected to switches of the key code setter 17 for grounding the switches of the key code setter 17 sequentially.

The reference character A in FIG. 4 shows the timing of the output $Q_A$ of the counter 15 and reference characters B to E the output timings of the signals $Q_B$ to $Q_E$ of the counter 15.

The output $Q_E$ of the counter 15 and the key code signal reversed through an inverter element 18 are combined by a NAND element 19. As shown in FIG. 4(F), a negative logic product is taken between a synchronous signal of the timing 22 and the key code signal set by the key code setter 17 and appearing during the timing 23.

This signal of FIG. 4 is modulated by the carrier frequency modulator 20 as a repetition signal and transmitted as a radio wave from the antenna 21. The signal thus propagated from the transmitter is received by the receiver shown in FIG. 5.

Figure 5:
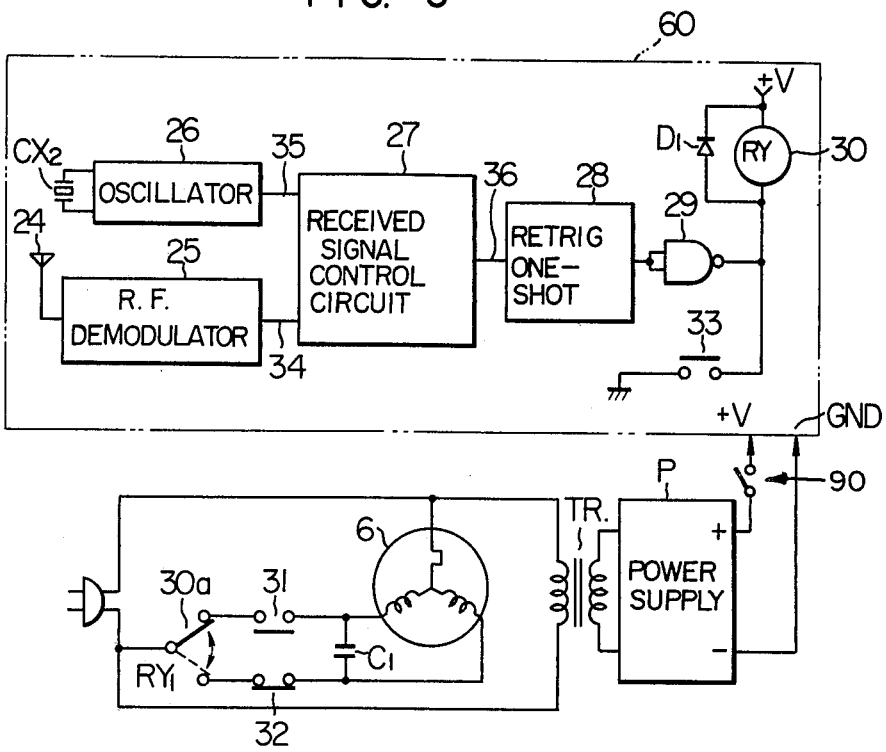
FIG. 5 is a circuit diagram showing the receiver section of the apparatus according to the present invention.

The block diagram of FIG. 5 shows the general configuration of the garage door operating device at the receiving end. The signal sent from the transmitter as shown in FIG. 3 is received by the antenna, demodulated by the radio frequency demodulator 25, and the resulting signal 34 is applied to the received signal control circuit 27. The clock signal 35 generated by the oscillator element Cx2 and the oscillator 26 is also applied to the received signal control circuit 27.

In the case where the key code at the receiving end predetermined by the received signal control circuit 27 coincides with the key code for the transmitted signal, a coincidence signal 36 is produced continuously and controls the relay driver 29 through the retriggerable one-shot multivibrator 28, thus actuating the relay 30 for driving the motor 6.

This relay 30 is of latch type which is reversed upon a single excitation, and the motor 6 starts to run at the time when the contact of the relay 30 is reversed (position shown by dashed line in the drawing).

With the starting of the motor 6, the garage door 12 begins to move down. When the door 12 reaches a lower limit, the lower limit switch 32 is actuated, so that the contact is opened thereby to cut off power supply to the motor 6, thus stopping the motor 6.

When the garage door 12 moves up, on the other hand, actuation of the upper limit switch 31 causes the motor 6 to stop.

If the door 12 stops in operation by some interference, the interference detection limit switch 33 is actuated and the relay 30 is excited again, thus reversing the rotational direction of the motor 6.

In the circuit shown in FIG. 5, a constant voltage is supplied from the power supply P through the transformer TR. A manual lock switch 90 is connected as required to the stabilizing power supply P and the control section. Power from the power supply P of the control circuit is controlled by a manual lock switch 90 in such a manner that by turning off the manual lock switch 90, the operation of the garage door is automatically prohibited.

Figure 6:
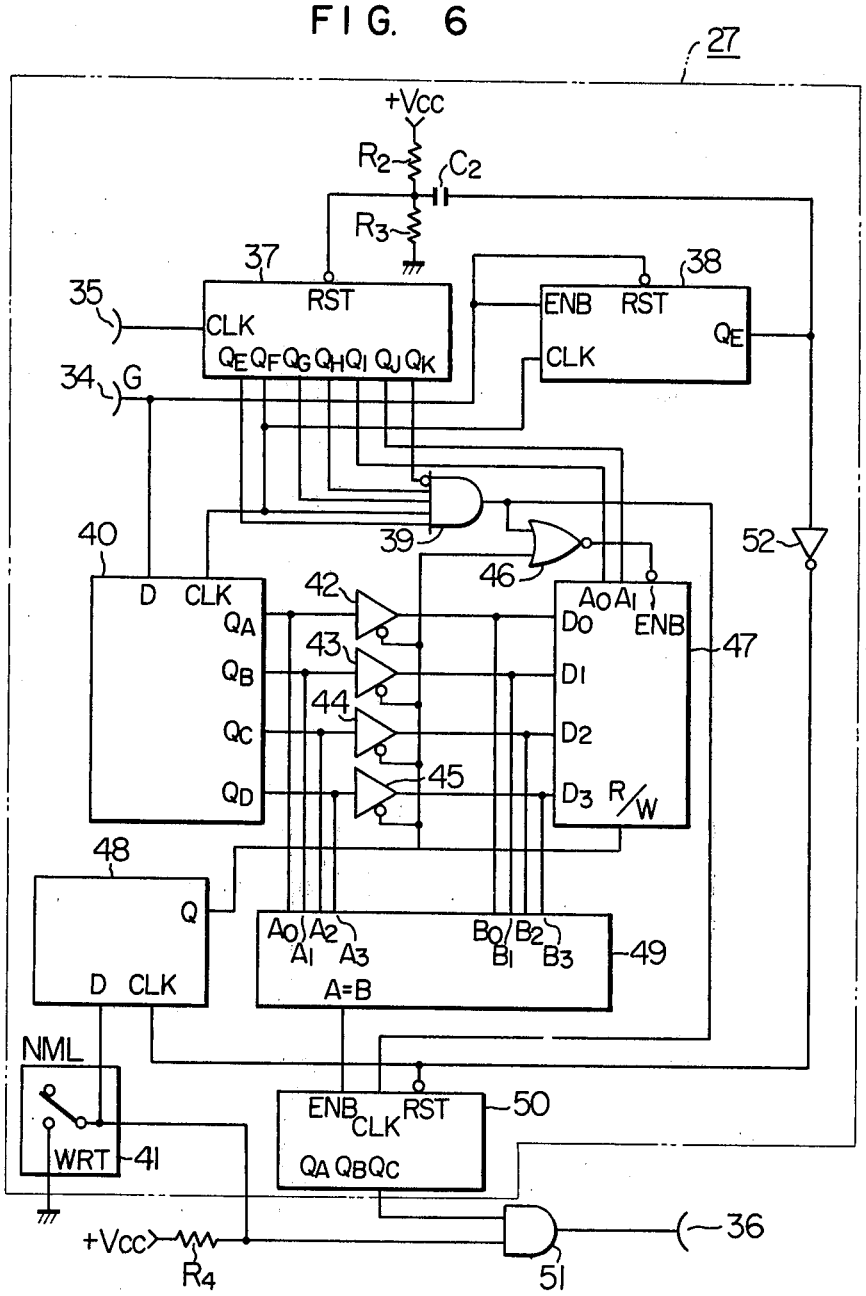
FIG. 6 is a wiring diagram of the received signal control circuit included in the circuit of FIG. 5.

The operation of the received signal control circuit 27 of the receiver mentioned above will be explained below with reference to the diagram of FIG. 6 and the time chart of FIG. 7.

Figures 7G, 7H, 7I, 7J, 7K, 7L, 7M, 7N, 7P:
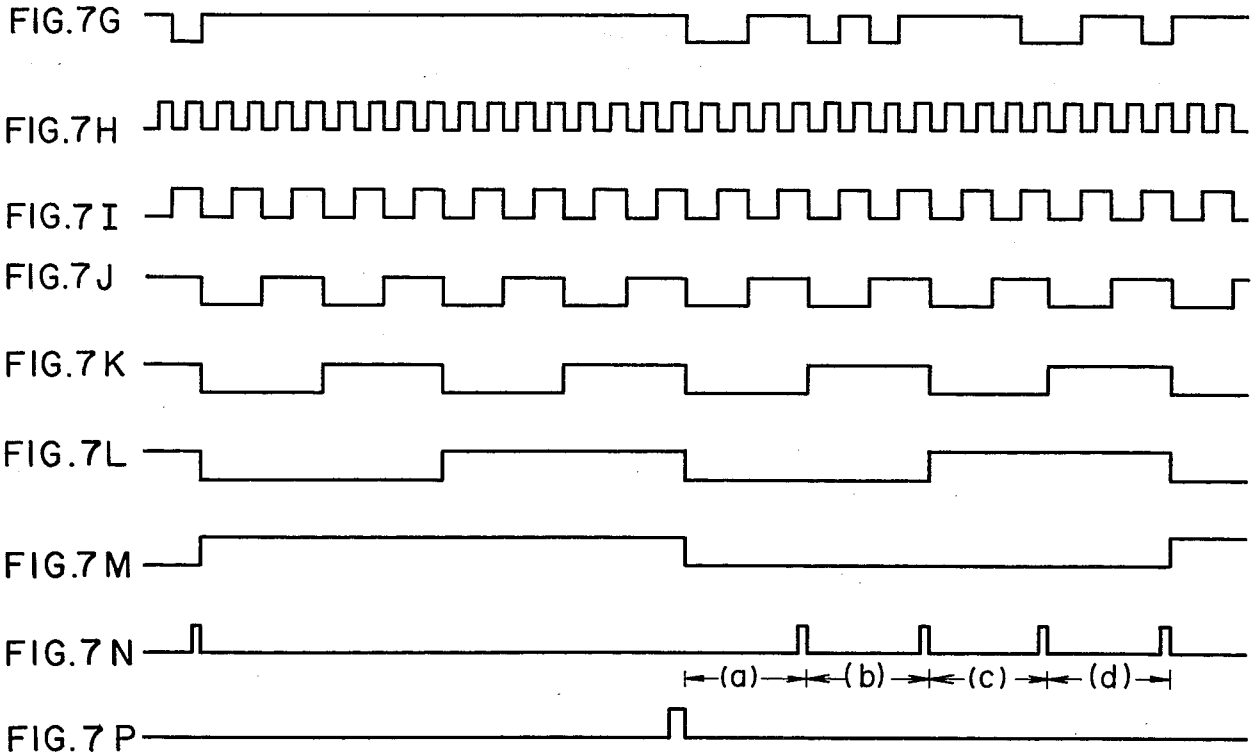
FIG. 7 is time chart showing output waveforms produced at various parts of the apparatus of FIG. 6 according to the present invention.

The demodulated signal 34 is applied as shown in G of FIG. 7, and the clock signal 35 is also received at a frequency 64 times higher than the clock signal (FIG. 4) of the transmitter. The clock signal 35 is applied to an 11-bit binary counter 37. The output $Q_F$ of the counter 37 (FIG. 7(H)) takes the form of clock signals to be applied to the modulo 32 counter 38 and the shift register 40.

The output terminals $Q_F$, $Q_G$ and $Q_H$ of the counter 37 are connected to the input terminals of the decoder 39, while the output terminals $Q_I$ and $Q_J$ are connected to the address input terminals $A_0$ and $A_1$ of the memory 47 respectively.

When the demodulated signal 34 (FIG. 7(G)) is applied to the counter 38 with the input signal at logic zero, the counter 38 is reset. Next, when the input changes to logic 1, the counter 38 counts the number of clock pulses of the signal H from $Q_f$ at the rise timing of the waveform of FIG. 7(H) during the logic 1 state of the signal G. When the number of clock pulses of signal H thus counted reaches 16, the output $Q_E$ of the counter 38 (FIG. 7(P)) turns to logic 1.

The counter 38 opens the gate thereof when the signal G is logic 1, thus starting to count the clock pulses, while it is reset when the signal G is in logic 0 state.

The counter 38 is reset at the timing when the signal 34 shown in FIG. 7(G) becomes logic zero. Under this condition, the output $Q_E$ of the counter 38 takes the form as shown in FIG. 7(P), and the differentiator circuit including the capacitor $C_2$, and the resistors $R_2$ and $R_3$ resets the counter 37 at the trailing edge of the pulse in FIG. 7(P).

As a result, the counter 37 is regulated at the data transfer period. The signal P is also used as a clock signal of the flip-flop 48 for determining the receiving mode and the reset signal for the data receiving counter 50 through the inverter 52.

Further, the signal 34 is sampled by the shift register 40 at the rise timing of the output $Q_F$ (FIG. 7(H)) of the counter 37, so that an output signal in groups of four bits is produced at the output terminals $Q_A$ to $Q_D$ of the shift register 40.

Next, explanation will be made of the case in which the key code sent from the transmitter is stored in the memory 47.

When the receiving mode change-over switch 41 is turned to write side WRT, the input to the input terminal D of the flip-flop 48 turns to zero, so that the output Q of the flip-flop 48 becomes zero at the rise timing of the signal shown in FIG. 7(P).

The output Q of the flip-flop 48 causes the buffer drivers 42 to 45 to conduct, thus transferring the output of the shift register 40 to the memory 47. The memory 47 is switched between read and write modes R and W in response to the output Q of the flip-flop 48. The read mode is effective when the output Q is 1, while the write mode is present when the output Q is 0. Thus, upon application of an input signal to the ENB input terminal, a reading or writing operation, as the case may be, becomes possible.

In this way, in response to the outputs $Q_I$ and $Q_J$ of the counter 37, address signals are input and in synchronism with these address signals the data received sequentially from the transmitter at the timing of the output of the decoder 39 shown in FIG. 7(N) is stored in the memory 47.

During the period (a) in FIG. 7(N), for instance, an output 1100 is produced at the terminals A to D of the shift register and applied to the input terminals $D_0$ to $D_3$ of the memory 47 for storage therein.

Subsequently, codes corresponding to FIG. 7(G) are stored in the periods (b), (c) and (d) at the timing shown in FIG. 7(N).

When the switch 41 is turned to normal side NML, on the other hand, the input D of the flip-flop 48 turns to 1 state as in the case of read state at SRT, whereupon the output Q of the flip-flop 48 also takes the form of 1 state.

As a result, the buffer drivers 42 to 45 are turned off, so that the data stored in the shift register 40 and also the key code stored in the memory 47 which are coincident with the timing of the received signal are applied in groups of four bits to the comparator 49 respectively.

When the two signals mentioned above are found to be coincident with each other by the comparator 49, the counter 50 is actuated. The number in which the received data is coincident with the key code in groups of four bits is counted at the output timing of the decoder 39 shown in FIG. 7(N). When the coincidence is detected four times in succession, the NAND circuit 51 produces a pulse signal each time of coincidence.

As will be understood from the foregoing description, according to the present invention, the switches of the prior art for setting the key code for the transmitter and receiver may be replaced by a single change-over switch 41. This prevents a switch setting error which might occur at the time of setting a key code in the prior art on the one hand and improves the operating efficiency on the other hand.

In the above-mentioned embodiment, a random access memory (RAM) was used as the memory 47. If EAROM of General Instruments International or the like is used instead of a RAM, however, battery backup is not required against the disappearance of a key code due to power cut off, thus making possible key code storage in spite of an instant or protracted power failure.

According to another modification of the invention, the parallel processing as in the above-mentioned embodiment may be replaced by series processing by introducing the program processing with a microcomputer or the like.

A control device for automatically locking the garage door by a specific signal transmitted from the transmitter will be explained below with reference to FIG. 8.

Figure 8:
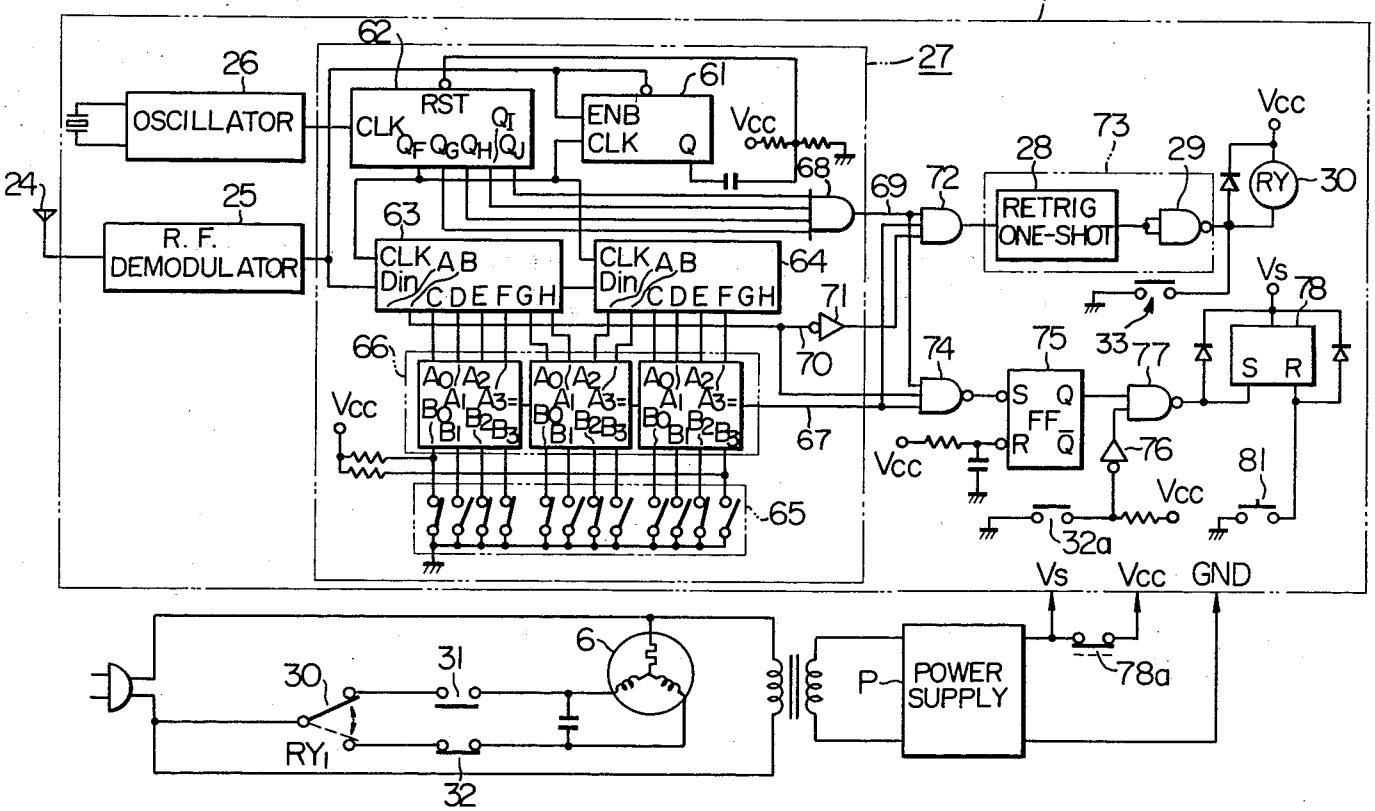
FIG. 8 is a wiring diagram showing another embodiment of the present invention having a door lock mechanism according to the present invention.

The diagram of FIG. 8 shows another embodiment having means for automatically prohibiting the operation of the garage door in response to the specific signal produced from the received signal control circuit 60 in the garage door control device of FIG. 5. In this drawing, the signal transmitted from the transmitter shown in FIG. 3 is applied to the demodulator 25 through the receiving antenna 24. The output of the demodulator 25 is applied as received data to the shift registers 63 and 64 by the outputs from the binary counter 61 for detecting the synchronous signal and the binary counter 62 for generating the data-detecting clock signal. This received data is compared with the data set in the key code setter means 65 by the comparator 66, thus generating a data coincidence signal 67.

In this embodiment, a switch is shown as the key code setter means 65. As shown in the first embodiment, however, the switch may be replaced by a memory with equal effect, as easily understood. The outputs $Q_G$, $Q_H$, $Q_I$ and $Q_J$ of the binary counter 62 are applied to the four-input AND gate 68 wherefrom the receipt completion signal 69 is generated.

On the other hand, the output signal 70 from the terminal B of the shift register 63 is applied to the AND gate 72 through the inverter 71 together with the coincidence signal 67 and the receipt completion signal 69, and the AND gate 72 produces a logical produce of these input signals. A command signal for door lock is also produced from the terminal B of the shift register 63. When the 14-bit command switch 53 of the code setter 17 in the transmitter end is off, i.e., when the signal of the 14th bit in the signal F in FIG. 4 is high (H) (state shown by shadowed part), a door lock command is issued, while when the signal is low (L), only a door operation is commanded. In this way, depending on whether the output 70 at the terminal B is high or low, it is decided whether a door lock command signal is present or absent.

When the output signal 70 at the terminal B of the shift register 63 is low (L), the output of the inverter 71 is high (H), so that the relay 30 is excited through the AND gate 72, and the retriggerable one-shot multivibrator 28 and the relay driver 29 of the motor driving circuit 73. As a result, the motor 10 is driven through the relay contact 30*a*, thus controlling the operation of the garage door 12 as shown in FIG. 5.

In the case where the output 70 at the terminal B of the shift register 63 is high (H), by contrast, i.e., in the case where a door lock command is issued at the transmitting end, the output 70 produced at the terminal B is applied to the AND gate 74 together with the coincidence signal 67 and the receipt completion signal 69. As a consequence, the output of the AND gate 74 causes the flip-flop 75 to be set, and if the other contact 32*a* of the lower limit switch 32 of the garage door 12 is closed when the output is produced from the flip-flop 75, i.e., if the door 12 is closed completely under such a condition, all the inputs to the AND circuit 77 are high (H), and therefore the AND gate 77 produces a set signal for the latching relay 78.

Figure 9:
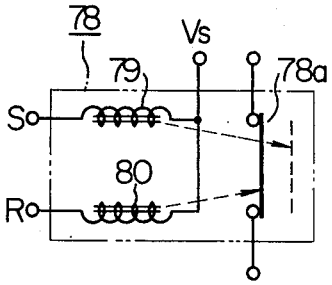
FIG. 9 is a diagram for explaining the latching relay.

In response to the set signal, the coil 79 of the latching relay 78 is excited as shown in FIG. 9, thus opening the contact 78*a*. When the reset signal is applied to the relay 78, on the other hand, the coil 80 is excited, thus closing the contact 78*a*.

The contact 78*a* of this latching relay 78 is connected in series with the control voltage supply line $V_{cc}$ of the control circuit 60 and the stabilizing power supply P, the application of the set signal to the latching relay 78 causes the contact 78*a* to open, thus cutting off the supply of control voltage $V_{cc}$ to the control circuit 60.

In the description above, it is assumed that the door 12 is closed when the flip-flop 75 is set. If the door is open, however, only a motor driving signal is transmitted from the transmitter in the first place. In other words, a code signal is transmitted with the command switch 53 of the code setter 17 closed for commanding a door lock. As a result, the motor driving circuit 73 in the control circuit 60 is actuated and the motor 6 is driven through the latch relay 30 as explained above, thus closing the door 12.

After the door 12 begins to close, a door lock command is issued again through the command switch 53 at the transmitting end, and after the 14th bit of the code setter 17 is made high (H), the signal is transmitted. Thus a high (H) signal 70 is produced at the terminal B of the register 63, so that the AND gate 72 of the motor driving circuit 73 fails to produce an output as a result of the inverter 71, thus maintaining the latching relay 78 in the same condition. The flip-flop 75, on the other hand, is set by the output of the AND gate 74 and memorizes that the door lock command has been issued.

When the door 12 is closed and the limit switch 32 opens, power supply to the motor 10 is cut off and the motor stops. At the same time, the other limit switch 32*a* is closed, and therefore the signal passed through the switch 32 combines with the output of the flip-flop 75 to actuate the latching relay 78 through the AND gate 77, thus cutting off all the control voltage $V_{cc}$ of the control circuit 60 is explained above.

If a signal is transmitted from the transmitter with the switch 53 closed for commanding a door lock and received properly at the receiving end, the closing of the door 12 cuts off all the control voltage of the control circuit 60, thus prohibiting subsequent automatic door operation by radio control. This condition is held until the operator operates the reset button 81 manually for resetting the latching relay 78.

Figure 10:
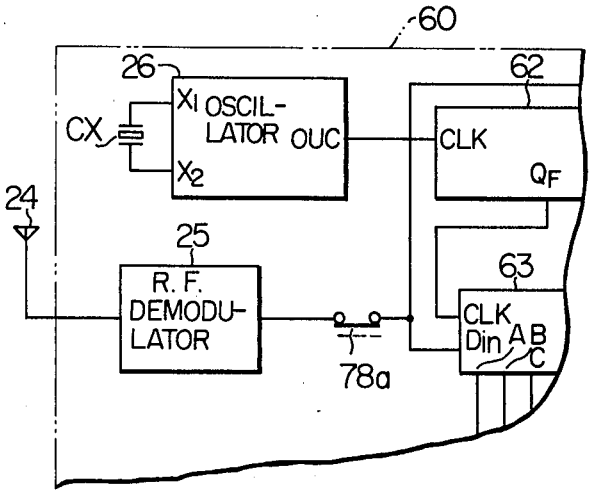
FIG. 10 is a wiring diagram of the essential parts according to the embodiment of the present invention shown in FIG. 8.

In the embodiment shown in FIG. 8, the contact 78*a* of the latching relay 78 actuated by a door lock command turns off the control voltage $V_{cc}$. As an alternative, the contact 78*a* may be connected in series with the output terminal of the demodulator 25 for demodulating the signal transmitted from the transmitter and received at the antenna 24 of the receiver and producing a data signal, so that the output of the demodulator 25 may be cut off directly as shown in FIG. 10.

What is claimed is:

1. A remote controlled automatic control apparatus which is responsive to a modulated signal containing a preselected code, comprising:

receiver means for receiving and demodulating the signal containing the preselected code;

first memory means connected to said receiver means for storing the signal received and demodulated by said receiver means;

second memory means for storing a signal containing a preset code;

comparator means connected to said first and second memory means for comparing the preselected code of said received signal with the preset code of the signal stored in said second memory means and for producing an output signal when a comparison is detected;

manually-actuatable connecting means which, when actuated, selectively connects said first memory means to said second memory means to cause said second memory means to store therein the contents of said first memory means as the signal containing the preset code and at the same time disables said comparator means from effecting its comparing operation, and which, when deactuated, disconnects said second memory means from said first memory means and at the same time enables said comparator means to effect its comparing operation; and driving means responsive to the output signal of said comparator means for producing a driving output.

2. An apparatus according to claim 1, wherein said signal received and demodulated by said receiver means and said signal stored in said second memory means are coded pulse signals, and further including timing means for addressing said first and second memory means to read out the respective signals stored in said first and second memory means to said comparator means as sequential pulse groups, and counter means connected to said comparator means for actuating said driving means when comparison is detected between a predetermined number of groups of pulses.

3. An apparatus according to claim 2, wherein said second memory means comprises a read/write memory having data terminals and being addressed by said timing means, said first memory means comprising a shift register connected to said receiver means for storing sequentially-received groups of pulses from said receiver means, said connecting means comprising gate means selectively connecting the outputs of said shift register to the data terminals of said read/write memory and manual control means for actuating said gate means while enabling said read/write memory to effect storing therein of signals applied to the data terminals thereof coincident with addressing by said timing means.

4. An apparatus according to claims 1, 2, or 3, further including means responsive to a signal containing a specific preselected code for disabling said driving means.

5. An apparatus according to claim 3, further including means responsive to signal containing a specific preselected code for disconnecting said receiving means from said shift register.

6. A remote-controlled automatic control apparatus comprising:

(a) a door operating device including a driving unit for moving a door between open and closed positions;

(b) control means for automatically controlling the operation of said door operating device including a transmitter and a receiver;

(c) said transmitter including means for transmitting a modulated signal containing at least a specific code; and (d) said receiver including means for receiving a signal including the specific code transmitted from said transmitter, first memory means connected to said signal receiving means for storing the signal received by said signal receiving means, second memory means for storing a signal containing a preselected code, comparator means connected to said first and second memory means for collating the specific code of said received signal stored in said first memory means with the preselected code of the signal stored in said second memory means and for generating an output signal when said received code has a predetermined relationship with said preselected code, means for issuing an operation command to said door operating device in response to the output signal from said comparator means, and manually-actuatable connecting means which, when actuated, selectively connecting said first memory means to said second memory means to cause said second memory means to write therein the contents of said first memory means as said signal with said preselected code and at the same time disables said comparator means from effecting its comparing operation, and which, when deactuated, disconnects said second memory means from said first memory means and at the same time enables said comparator means to effect its comparing operation.

7. A control apparatus according to claim 6, wherein said connecting means includes manually-operable means to effect actuation of said connecting means.

8. A control apparatus according to claim 6, further comprising limit means for automatically cutting off the operation of said control means after the completion of the operation of said door operating device to move the door to its open or closed positions in response to the signal transmitted by said transmitter.

9. A remote-controlled automatic control apparatus comprising:

(a) a door operating device including a driving unit for moving a door between open and closed positions;

(b) control means for automatically controlling the operation of said door operating device including a transmitter and a receiver;

(c) said transmitter including means for transmitting a signal containing a specific code, a door operation command signal and a door lock command signal; and (d) said receiver including means for receiving a signal including the specific code transmitted from said transmitter, memory means for storing a signal having a preselected code, comparator means for collating the code of said received signal with the preselected code of said stored signal and for generating an output signal when said received code has a predetermined relationship with said preselected code, means for issuing an operation command to said door operating device from said comparator means, signal switching means for selectively connecting the output of said receiving means to said memory means to effect a storage of the signal transmitted from said transmitter means in said memory means as said signal with said preselected code;

(e) limit means for automatically cutting off the operation of said control means after the completion of the operation of said door operating device to move the door to its open or closed positions in response to the signal transmitted by said transmitter; and (f) storage means for temporarily storing at least a selected one of said two signals and means responsive to said door lock command signal for inhibiting operation of said door operating device.

10. A control apparatus according to claim 9, further comprising means for ANDing the door operation command signal and said door lock command signal to produce an ANDed signal, means for storing said ANDed signal, means for producing an output signal in response to the storing of said ANDed signal only when said limit means indicates that the door operating device has moved the door to its closed position, and means for inhibiting operation of said door operating device in response to production of said output signal.

11. A control apparatus according to claim 9, further comprising means for ANDing the door operation command signal and an operation stop signal to produce an ANDed signal, means for storing said ANDed signal, and means for preventing said door operating device from being actuated when said limit means indicates that said door operating device has moved the door to its closed position and said ANDed signal has been stored, thus making the control apparatus temporarily inoperative.

12. A remote-controlled automatic control apparatus which is responsive to a modulated signal containing a preselected code, comprising receiver means for receiving and demodulating the signal containing the preselected code;

memory means for storing a signal containing a preset code;

comparator means connected to receive the outputs of said receiver means and said memory means for comparing the preselected code of said received signal with the preset code of the signal stored in said memory means and for producing an output signal when a comparison is detected;

connecting means for selectively connecting the output of said receiver means to said memory means to effect a storing in said memory means of the received signal as the signal containing the preset code; and driving means responsive to the output signal of said comparator means for producing a driving output.

13. An apparatus according to claim 12, wherein said received signal and said stored signal are coded pulse signals, and further including timing means for addressing said memory means to read out the received signal and the stored signal to said comparator means as sequential pulse groups, and counter means connected to said comparator means for actuating said driving means when comparison is detected between a predetermined number of groups of pulses.

14. An apparatus according to claim 13, wherein said memory means comprises a read/write memory having data terminals and being addressed by said timing means, and further including a shift register connected to said receiving means for storing sequentially-received groups of pulses from said receiver means, said connecting means comprising gate means selectively connecting the outputs of said shift register to the data terminals of said read/write memory and manual control means for actuating said gate means while enabling said read/write memory to effect storing therein of signals applied to the data terminals thereof coincident with addressing by said timing means.

15. An apparatus according to claims 12, 13, or 14, further including means responsive to a signal containing a specific preselected code for disabling said driving means.

16. An apparatus according to claim 14, further including means responsive to a signal containing a specific preselected code for disconnecting said receiving means from said shift register.

17. A remote-controlled automatic control apparatus comprising:

(a) a door operating device including a driving unit for moving a door between open and closed positions;

(b) control means for automatically controlling the operation of said door operating device including a transmitter and a receiver;

(c) said transmitter including means for transmitting a signal containing a specific code, a door operation command signal and a door lock command signal; and (d) said receiver including means for receiving a signal including the specific code transmitted from said transmitter, comparator means for collating the code of said received signal with a preselected code of a stored signal and for generating an output signal when said received code has a predetermined relationship with said preselected code, means for issuing an operation command to said door operating device in response to said output signal from said comparator means, memory means for storing transmitted signal a said preselected code, and signal switching means for selectively connecting the output of said receiving means to said memory means to effect storage of the signal transmitted from said transmitter means in said memory means as said signal with said preselected code.

18. A control apparatus according to claim 17, wherein said signal switching means includes manually-operable means to effect switching of said signal from said transmitter means into said memory means from the output of said receiving means.

19. A control apparatus according to claim 17, further comprising limit means for automatically cutting off the operation of said control means after the completion of the operation of said door operating device to move the door to its open or closed positions in response to the signal transmitted by said transmitter.

20. A control apparatus according to claim 17, further comprising means for producing a signal representing a logic product of the door operation command signal and said door lock command signal, means for producing an output signal in response to the signal representing said logic product only when said limit means indicates that the door operating device has moved the door to its closed position, and means for inhibiting operation of said door operating device in response to production of said output signal.

21. A control apparatus according to claim 17, further comprising means for producing a signal representing the logic product of the door operation command signal and an operation stop signal, and means for preventing said door operating device from being actuated when said limit means indicates that said door operating device has moved the door to its closed position and the signal representing said logic product has been produced, thus making the control apparatus temporarily inoperative.

* * * * *